US005291161A

United States Patent [19]

Saka

[11] Patent Number: 5,291,161

[45] Date of Patent: Mar. 1, 1994

[54] MICROWAVE BAND-PASS FILTER HAVING FREQUENCY CHARACTERISTIC OF INSERTION LOSS STEEPLY INCREASING ON ONE OUTSIDE OF PASS-BAND

[75] Inventor: Hiroshi Saka, Katano, Japan

[73] Assignee: Matsushita Electric Industrial Co., Ltd., Osaka, Japan

[21] Appl. No.: 916,252

[22] Filed: Jul. 21, 1992

[30] Foreign Application Priority Data

Jul. 22, 1991 [JP] Japan ..... 3-180868
Jul. 22, 1991 [JP] Japan ..... 3-180869

[51] Int. Cl.[5] ..... H01P 1/20
[52] U.S. Cl. ..... 333/204; 333/219
[58] Field of Search ..... 333/204, 246, 205, 238, 333/219

[56] References Cited

U.S. PATENT DOCUMENTS

| | | | |
|---|---|---|---|
| 3,678,433 | 7/1972 | Hallford | 333/204 |
| 3,721,919 | 3/1973 | Grace | 333/204 |
| 3,875,538 | 4/1975 | Minet et al. | 333/204 |
| 4,074,214 | 2/1978 | Aicholzer | 333/219 |
| 4,288,766 | 9/1981 | Okita | 333/204 |
| 4,489,292 | 12/1984 | Ogawa | 333/204 |
| 5,015,976 | 5/1991 | Saka | 333/204 |
| 5,021,757 | 6/1991 | Kobayashi et al. | 333/205 |

OTHER PUBLICATIONS

"A Printed-Circuit Hybrid-Ring Directional Coupler for Arbitrary Power Divisions", Agrawal et al., IEEE Transactions on Microwave Theory & Techniques, vol. MTT-34, No. 12, Dec. 1986, pp. 1401-1407.

"Narrowband elliptic filters on microstrip", Ness et al., Microwaves & RF, Nov. 1984, pp. 75-79 & 134.

*Primary Examiner*—Raymond A. Nelli
*Attorney, Agent, or Firm*—Wenderoth, Lind & Ponack

[57] ABSTRACT

In a microwave band-pass filter provided with a main line having an input terminal and an output terminal on both ends thereof, first, second, third and fourth open-ended stubs having lengths L1, L2, L3 and L4 connected electrically in parallel to the main line at intervals L0, L0' L0'', respectively. The lengths of two of the four open-ended stubs are selected to be substantially equal to a quarter of the wavelength of the first stop-band frequency signal on the band lower than the pass-band, and the lengths of the others thereof are selected to be substantially equal to a quarter of the wavelength of the second stop-band frequency signal on the band higher than the pass-band. In this case, the insertion loss thereof steeply increases on a boundary band from one stop-band to the pass-band. In particular, there can be obtained the microwave band-pass filter having a simpler structure, in which the insertion loss steeply increases on the band higher or lower than the pass-band, and the insertion loss on the band lower or higher than the pass-band is relatively large over a relatively wide band, respectively.

22 Claims, 11 Drawing Sheets

MICROWAVE BAND-PASS FILTER HAVING FREQUENCY CHARACTERISTIC OF INSERTION LOSS STEEPLY INCREASING ON ONE OUTSIDE OF PASS-BAND

BACKGROUND OF THE INVENTION

1. Field of the Invention

The present invention relates to a microwave band-pass filter, and more particularly, to a microwave band-pass filter using a transmission line such as a strip line, a micro-strip line or the like, which has a frequency characteristic of an insertion loss steeply increasing on one outside of the pass-band thereof.

2. Description of the Related Art

Conventionally, there have been used filters in order to take out a desirable signal on a predetermined band, or to reject signals or noise other than a desirable signal. In particular, when a frequency of the desirable signal to be taken out is located between frequencies of signals to be rejected, or when a stop-band is located on both the outsides higher and lower than a pass-band, there is used a band-pass filter.

FIG. 1 shows a conventional microwave band-pass filter of this type, which comprises resonators, each resonator composed of a half-wavelength strip line having both the open ends. Referring to FIG. 1, between input and output terminals, there are formed between a dielectric substrate 500 and another dielectric substrate (not shown), an input strip line 3, three resonators 5 and an output strip line 4 so that the input strip line 3 is electrically connected through an electromagnetic coupling to the first resonator 5 over a quarter of the wavelength, the first resonator 5 is electrically connected through an electromagnetic coupling to the second resonator 5 over a quarter of the wavelength, the second resonator 5 is electrically connected through an electromagnetic coupling to the third resonator 5 over a quarter of the wavelength, and the third resonator 5 is electrically connected through an electromagnetic coupling to the output strip line 4 over a quarter of the wavelength.

In the conventional microwave band-pass filter shown in FIG. 1, when the number of stages of the resonators 5 is increased, the insertion loss on the band on the outside of the pass-band can be steeply increased. However, each of the resonators 5 has a relatively low unloaded Q such as about several hundreds at about 10 GHz. Therefore, when the number of stages thereof is increased, the microwave band-pass filter is increased in size, and also the insertion loss in the pass-band increases. Accordingly, it is extremely difficult to obtain a microwave band-pass filter having a relatively low insertion loss on the pass-band and having a frequency characteristic of the insertion loss steeply increasing on the outside of the pass-band.

SUMMARY OF THE INVENTION

An object of the present invention is therefore to provide a microwave band-pass filter having an insertion loss in the pass-band thereof smaller than that of the conventional microwave band-pass filter, having an insertion loss in the stop-band thereof larger than that of the conventional microwave band-pass filter, and having a frequency characteristic of the insertion loss steeply increasing on one outside of the pass-band.

Another object of the present invention is to provide a microwave band-pass filter having a frequency characteristic of the insertion loss steeply increasing on one outside of the pass-band, which is capable of being miniaturized in size as compared with the conventional microwave band-pass filter.

In order to achieve the aforementioned objective, according to one aspect of the present invention, there is provided a microwave band-pass filter comprising:

a main line having an input terminal and an output terminal on both ends thereof; and first, second, third and fourth open-ended stubs having lengths L1, L2, L3 and L4, respectively, said first to fourth open-ended stubs connected electrically in parallel to said main line at intervals L0, L0' and L0'', respectively, wherein (a) the lengths L1 and L4 of said first and fourth open-ended stubs are selected to be substantially equal to a quarter of the wavelength of the first stop-band frequency signal on the band lower than the pass-band in such a manner that attenuation poles thereof are placed substantially within the band of the first stop-band frequency signal;

(b) the lengths L2 and L3 of said second and third open-ended stubs are selected to be substantially equal to a quarter of the wavelength of the second stop-band frequency signal on the band higher than the pass-band in such a manner that attenuation poles thereof are placed substantially within the band of the second stop-band frequency signal;

(c) the intervals L0, L0' and L0'', and the lengths L1, L2, L3 and L4 are selected so as to satisfy either one of first conditions of $2L0'<L2\approx L3<L1\approx L4<L0<2L1$, and second conditions of $2L0'<L2=L3<L1=L4<L0<2L1$ and so that $L0''=L0$ or $L0''\approx L0$.

In the above-mentioned microwave band-pass filter, the intervals L0 and L0' are preferably selected so that the interval L0 is larger than 6/16 of the wavelength of the pass-band frequency signal and is smaller than 8/16 thereof, the interval L0' is smaller than 2/16 of the wavelength of the pass-band frequency signal, and the interval $(L0+L0')$ is larger than 6/16 of the wavelength of the pass-band frequency signal and is smaller than 9/16 thereof.

In the above-mentioned microwave band-pass filter, there are preferably further provided with:

an input line connected between said input terminal and said main line; and an output line connected between said output terminal and said main line;

wherein said first and fourth open-ended stubs are preferably parallel-coupled with said main line so as to extend in parallel to a longitudinal direction of said main line, and characteristic impedances of said first and fourth open-ended stubs are larger than those of said input and output lines, respectively.

In the above-mentioned microwave band-pass filter, said second and third open-ended stubs are preferably parallel-coupled with said main line so as to extend in parallel to the longitudinal direction of said main line, and characteristic impedances of said second and third open-ended stubs are larger than those of said input and output lines, respectively.

According to another aspect of the present invention, there is provided a microwave band-pass filter comprising:

a main line having an input terminal and an output terminal on both ends thereof; and first, second, third and fourth open-ended stubs having lengths L1, L2, L3 and L4, respectively, said first to fourth open-ended stubs connected electrically in parallel to said main line at intervals L0, L0' and L0'', respectively, wherein (a) the lengths L1 and L4 of said first and fourth open-ended stubs are selected to be substantially equal to a quarter of the wavelength of the first stop-band frequency signal on the band higher than the pass-band in such a manner that attenuation poles thereof are placed substantially within the band of the first stop-band frequency signal;

(b) the lengths L2 and L3 of said second and third open-ended stubs are selected to be substantially equal to a quarter of the wavelength of the second stop-band frequency signal on the band lower than the pass-band in such a manner that attenuation poles thereof are placed substantially within the band of the second stop-band frequency signal; and (c) the intervals L0, L0' and L0'', and the lengths L1, L2, L3 and L4 are selected so as to satisfy either one of first conditions of $2L0<L1\approx L4<L2\approx L3<L0'<2L2$, and second conditions of $2L0<L1=L4<L2=L3<L0'<2L2$ and so that $L0''=L0$ or $L0''\approx L0$.

In the above-mentioned microwave band-pass filter, the intervals L0 and L0' are preferably selected so that the interval L0 is smaller than 2/16 of the wavelength of the pass-band frequency signal, the interval L0' is larger than 6/16 of the wavelength of the pass-band frequency signal and is smaller than 8/16 thereof, and the interval (L0+L0') is larger than 7/16 of the wavelength of the pass-band frequency signal and is smaller than 10/16 thereof.

In the above-mentioned microwave band-pass filter, there are preferably further provided with:

an input line connected between said input terminal and said main line; and an output line connected between said output terminal and said main line;

wherein said second and third open-ended stubs are preferably parallel-coupled with said main line so as to extend in parallel to a longitudinal direction of said main line, and characteristic impedances of said second and third open-ended stubs are larger than those of said input and output lines, respectively.

In the above-mentioned microwave band-pass filter, said first and fourth open-ended stubs are preferably parallel-coupled with said main line so as to extend in parallel to the longitudinal direction of said main line, and characteristic impedances of said first and fourth open-ended stubs are larger than those of said input and output lines, respectively.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

The preferred embodiments according to the present invention will be described below with reference to the attached drawings.

First Preferred Embodiment

Figure 2:
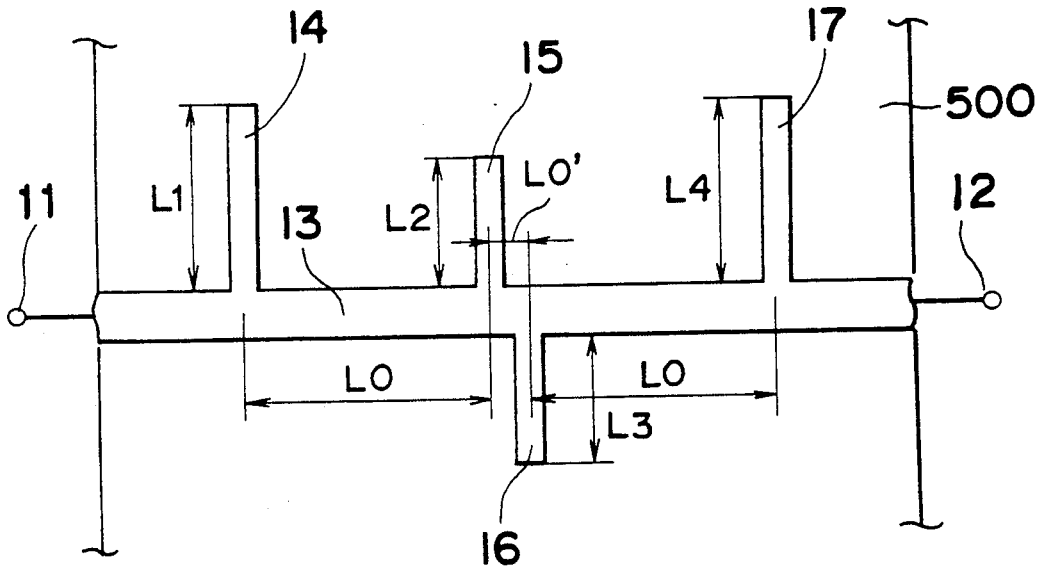
FIG. 2 is a plan view showing a microwave band-pass filter of a first preferred embodiment according to the present invention.

FIG. 2 shows a microwave band-pass filter of a first preferred embodiment according to the present invention.

Referring to FIG. 2, an input terminal 11 and an output terminal 12 are connected by a main line 13 composed of a strip line formed between a dielectric substrate 500 and another dielectric substrate (not shown). Open-ended stubs 14, 15, 16 and 17 having lengths L1, L2, L3 and L4 are connected in shunt with the main line 13, respectively, in an order of the stubs 14, 15, 16 and 17 at intervals L0, L0' and L0 so that the stubs 14, 15 and 17 extend toward the upper side in FIG. 2 and the stub 16 extends toward the lower side in FIG. 2.

The lengths L1 and L4 of the open-ended stubs 14 and 17 are selected to be equal to a quarter or substantially a quarter of the wavelength of the stop-band frequency signal or the image signal on the band lower than the pass-band in such a manner that attenuation poles thereof are placed within or in the vicinity of the band of the stop-band frequency signal. Further, the lengths L2 and L3 of the open-ended stubs 15 and 16 are selected to be equal to a quarter or substantially a quarter of the wavelength of another stop-band frequency signal on the band higher than the pass-band in such a manner that attenuation poles thereof are placed within or in the vicinity of the band of another stop-band frequency signal. These requirements are referred to as a first requirement hereinafter.

The intervals L0 and L0', and the lengths L1, L2, L3 and L4 are selected so as to satisfy either conditions of $2L0' < L2 \approx L3 < L1 \approx L4 < L0 < 2L1$, or conditions of $2L0' < L2 = L3 < L1 = L4 < L0 < 2L1$. These requirements are referred to as a second requirement hereinafter.

Further, at the same time, the intervals L0 and L0' are preferably selected so that the interval L0 is larger than 6/16 of the wavelength of the pass-band frequency signal and is smaller than 8/16 thereof, the interval L0' is smaller than 2/16 of the wavelength of the pass-band frequency signal, and the interval (L0+L0') is determined at a value equal to about a quarter of the wavelength of the pass-band frequency signal. These requirements are referred to as a third requirement hereinafter.

Figure 3:
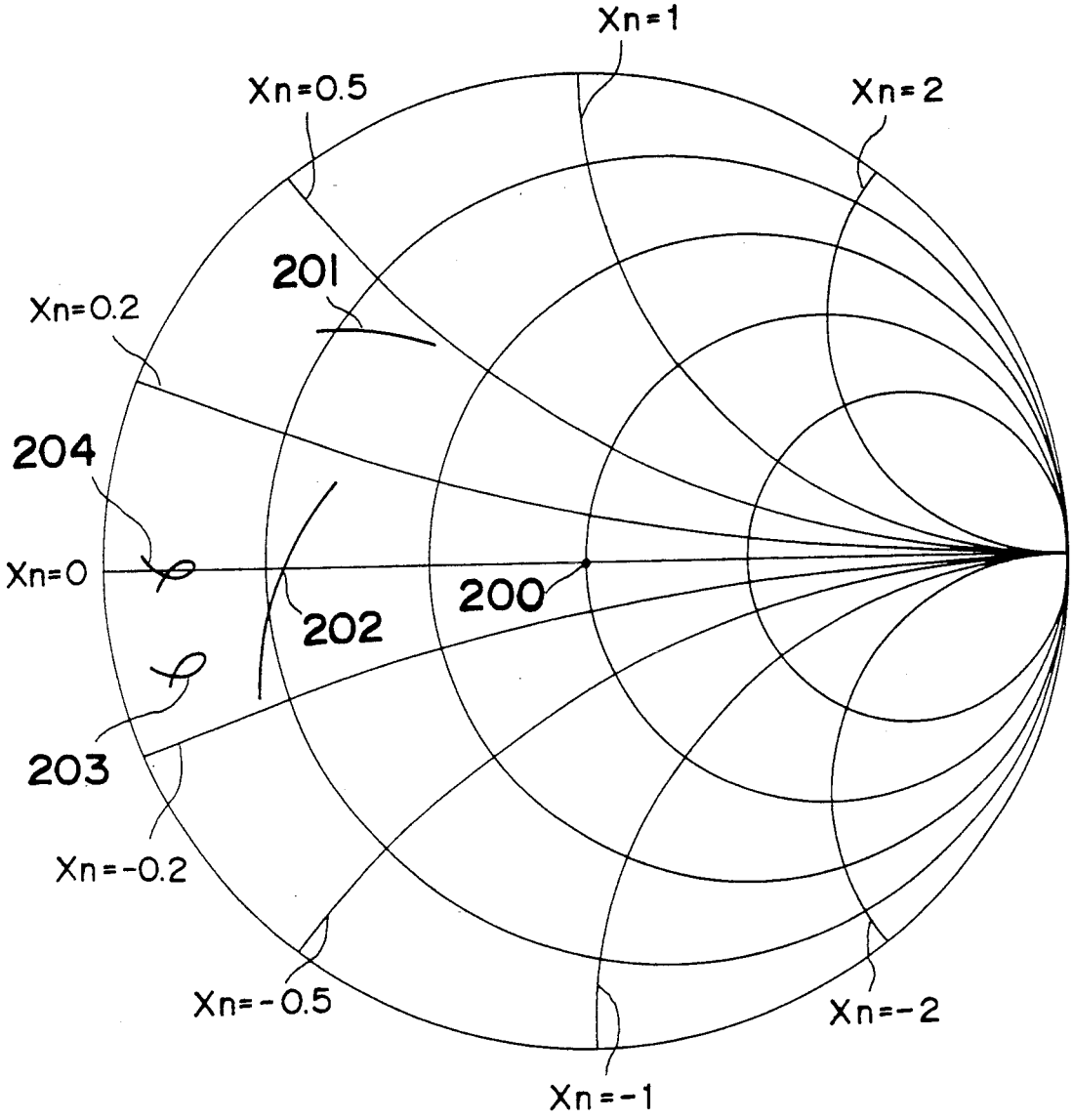
FIG. 3 is a Smith chart showing an action on a pass-band of the microwave band-pass filter shown in FIG. 2.

FIG. 3 is a Smith chart showing an action on a pass-band of the microwave band-pass filter shown in FIG. 2. The action on the pass-band having a predetermined frequency range thereof will be described below with reference to FIG. 3.

In the microwave band-pass filter shown in FIG. 2, each of the open-ended stubs 14 and 17 operates as an inductive element connected electrically in parallel with the main line 13, and each of the open-ended stubs 15 and 16 operates as a capacitive element connected electrically in parallel with the main line 13.

As shown in FIG. 3, an impedance 200 of a load having a characteristic impedance Zo connected to the input terminal 11 is converted into an impedance 201 changing in a relatively large range on the pass-band by the inductive open-ended stub 14, and then, the impedance 201 is converted into an impedance 202 changing in a relatively large range on the pass-band by a strip line having the length L0 which is a part of the main line 13. Further, the impedance 202 is converted into a relatively low and capacitive impedance 203 ($Z_{203}=R_{203}-jX_{203}$; $X_{203}>0$) changing in a relatively small range on the pass-band by the capacitive open-ended stub 15, and then, the impedance 203 is converted into a relatively low and substantially purely resistive impedance 204 ($=R_{203}$) changing in a relatively small range on the pass-band by a strip line having half the length L0' which is another part of the main line 13.

On the other hand, since the microwave band-pass filter has a symmetric structure to the input and output terminals 11 and 12, an impedance of a load having a characteristic impedance Zo connected to the output terminal 12 is converted into a relatively low and substantially purely resistive impedance changing in a relatively small range on the pass-band which is substantially the same as the impedance 204, by the inductive open-ended stub 17, a strip line having the length L0 which is a part of the main line 13, the capacitive open-ended stub 16 and a strip line having half the length L0' which is another part of the main line 13.

Accordingly, the microwave band-pass filter shown in FIG. 2 has a band-pass characteristic on the pass-band, and has a band-stop characteristic on both the outsides of the pass-band by the open-ended stubs 14 to 17. Further, in the present preferred embodiment, the capacitive open-ended stubs 15 and 16 operate, respectively, as means for converting the inductive open-ended stubs 14 and 17 having the impedances changing in relatively large ranges on the pass-band into impedances changing in relatively small ranges on the pass-band. Therefore, since it is necessary to appropriately increase changes in the impedance or the capacitances on the pass-band of the capacitive open-ended stubs 15 and 16, the attenuation poles of the capacitive open-ended stubs 15 and 16 are set so as to be closer to the pass-band frequency than the attenuation poles of the inductive open-ended stubs 14 and 17.

Figure 4:
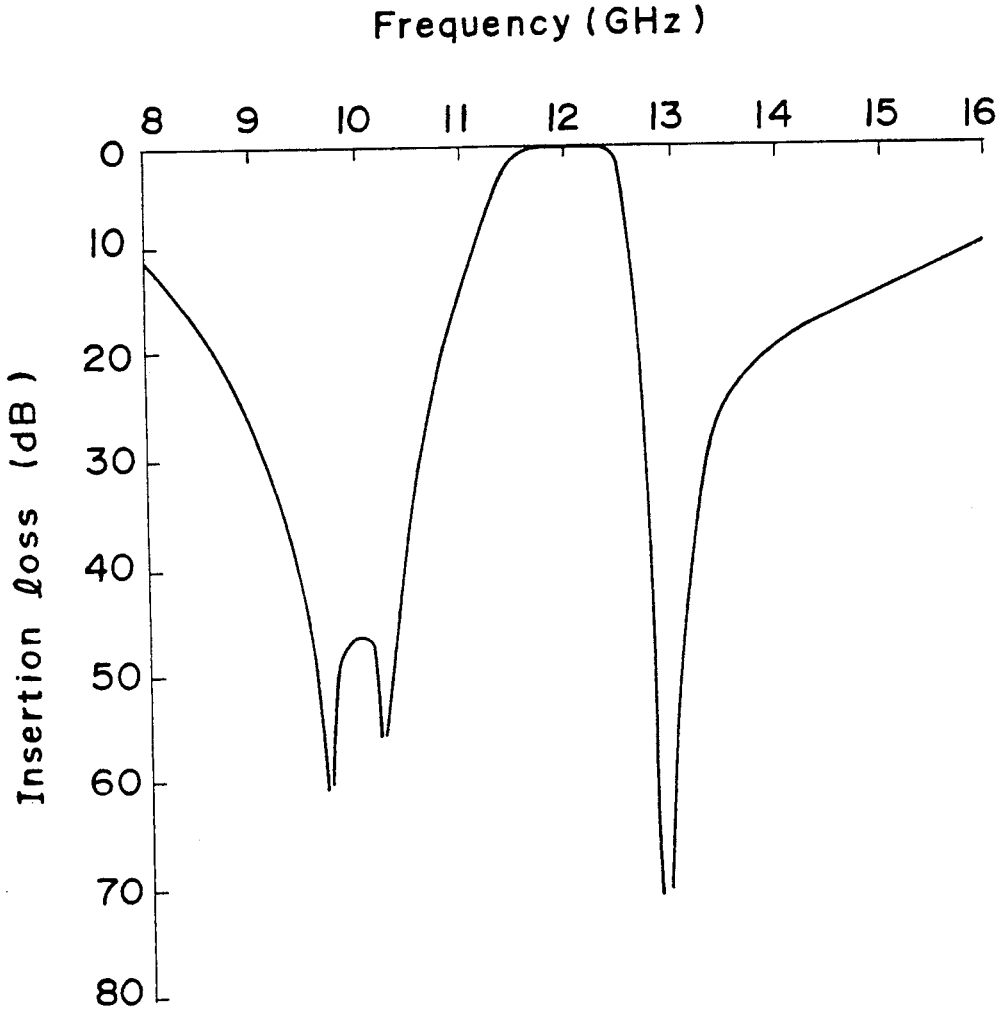
FIG. 4 is a graph showing a frequency characteristic of an insertion loss of the microwave band-pass filter shown in FIG. 2.

FIG. 4 is a graph showing a frequency characteristic of an insertion loss of the microwave band-pass filter shown in FIG. 2. In this case, parameters are set as follows:

(a) the relative dielectric constant of the dielectric substrates 500 for the strip line is set to 2.5;

(b) the thickness thereof is set to 0.6 mm;

(c) the line width of the main line 13 is set to 1.6 mm, resulting in setting the characteristic impedance Zo thereof to 50 Ω;

(d) the line width of each of the open-ended stubs 14 to 17 is set to 0.6 mm, resulting in setting the characteristic impedance thereof to 90 Ω; and (e) the intervals L0 and L0', and the lengths L1, L2, L3 and L4 are set so that L0=7.48 mm, L0'=0.62 mm, L1=5.53 mm, L2=L3=4.13 mm and L4=5.33 mm.

The microwave band-pass filter of the present preferred embodiment has a reflection loss larger than 13 dB in a frequency range from 11.7 to 12.4 GHz. As is apparent from FIG. 4, it has an insertion loss larger than 30 dB in a frequency range from 9.2 to 10.4 GHz, and has an insertion loss larger than 20 dB in a frequency range from 12.7 to 13.8 GHz.

Therefore, the microwave filter having the frequency characteristic shown in FIG. 4 has a pass-band from 11.7 to 12.4 GHz, and has a stop-band from 9.2 to 10.4 GHz and another stop-band from 12.7 to 13.8 GHz. In particular, the microwave filter of the present preferred embodiment certainly operates as a microwave band-pass filter requiring for a relatively large insertion loss on the band lower than the pass-band, and can be advantageously used as a microwave band-pass filter wherein the stop-bands thereof are located on both the outsides of the pass-band, band widths of the pass-band and the stop-band are finite, the insertion loss on the band lower than the pass-band is relatively large over a relatively wide band, and the insertion loss steeply increases on the band higher than the pass-band.

Figure 1:
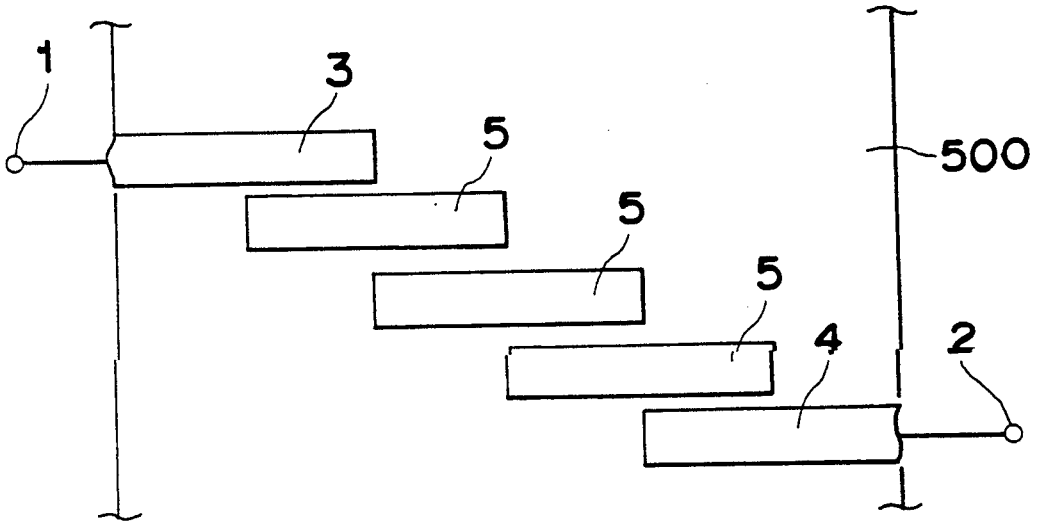
Fig. 1 PRIOR ART
FIG. 1 is a plan view showing a conventional microwave band-pass filter.

Since the microwave band-pass filter shown in FIG. 2 has a structure comprising the open-ended stubs 14 to 17 connected electrically in parallel with the main line 13, the insertion loss on the pass-band can be decreased as compared with the conventional microwave band-pass filter shown FIG. 1. Further, since the intervals L0 and L0', and the lengths L1, L2, L3 and L4 are set so as to satisfy the above-mentioned first and second requirements, the insertion loss steeply increases on a boundary band from one stop-band to the pass-band. In particular, since the attenuation poles of the open-ended stubs are set to be adjacent to the higher band of the pass-band, this results in the microwave band-pass filter having a simpler structure, in which the insertion loss steeply increases on the band higher than the pass-band, and the insertion loss on the band lower than the pass-band is relatively large over a relatively wide band.

In the first preferred embodiment, the interval L0 between the stubs 14 and 15 is the same as that between the stubs 16 and 17. However, the present invention is not limited to this, the interval L0 between the stubs 14 and 15 may be substantially the same as that between the stubs 16 and 17, and then, there can be obtained substantially the same frequency characteristic thereof.

The following things can be relatively easily understood from the conversions of the impedances shown in FIG. 3. The intervals L0 and L0' are preferably selected so as to satisfy the third requirement and so that the interval (L0+L0') is larger than 6/16 of the wavelength of the pass-band frequency signal and is smaller than 9/16 thereof. In this case, there can be obtained a superior microwave band-pass filter in which the insertion loss steeply increases on the band higher than the pass-band, and the insertion loss on the band lower than the pass-band is relatively large over a relatively wide band.

Second Preferred Embodiment

Figure 5:
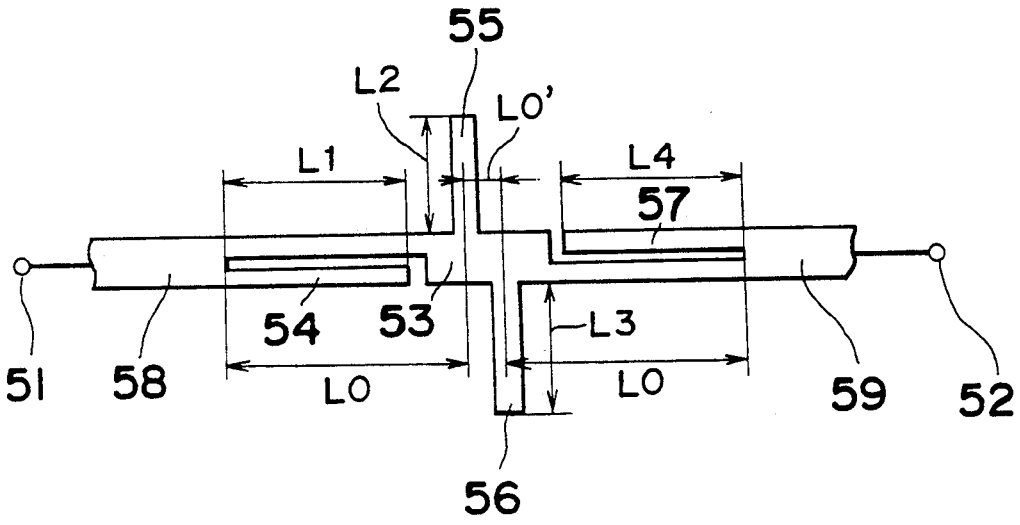
FIG. 5 is a pattern diagram showing a microwave band-pass filter of a second preferred embodiment according to the present invention.

FIG. 5 is a pattern diagram showing a microwave band-pass filter of a second preferred embodiment according to the present invention, in which the dielectric substrates are omitted.

Referring to FIG. 5, an input terminal 51 and an output terminal 52 are connected through input and output lines 58 and 59 each of a strip line, by a main line 53 composed of a strip line formed between dielectric substrates (not shown). Open-ended stubs or lines 54 and 57 having lengths L1 and L4 are parallel-coupled through electromagnetic couplings to the main line 53, respectively, so as to extend from ends of the input and output lines 58 and 59 toward the center of the main line 53 in a direction parallel to the longitudinal direction of the main line 53. Further, open-ended stubs 55 and 56 having lengths L2 and L3 are connected in shunt with the main line 53, respectively, at an interval L0' from each other, so that the stub 55 extends from a position apart from the end of the input line 58 by an interval L0 toward the upper side in FIG. 5 and the stub 56 extends from another position apart from the end of the output line 59 by the interval L0 toward the lower side in FIG. 5. Namely, the stubs 54 to 57 are connected electrically in parallel to the main line 53 at the intervals L0, L0' and L0 between the end of the input line 58 and the end of the output line 59.

The lengths L1 and L4 of the parallel-coupled stubs 54 and 57 are selected to be equal to a quarter or substantially a quarter of the wavelength of the stop-band frequency signal or the image signal on the band lower than the pass-band in such a manner that attenuation poles thereof are placed within or in the vicinity of the band of the stop-band frequency signal. Further, the lengths L2 and L3 of the open-ended stubs 55 and 56 are selected to be equal to a quarter or substantially a quarter of the wavelength of another stop-band frequency signal on the band higher than the pass-band in such a manner that attenuation poles thereof are placed within or in the vicinity of the band of another stop-band frequency signal. These requirements are referred to as a first requirement hereinafter.

The intervals L0 and L0', and the lengths L1, L2, L3 and L4 are selected so as to satisfy either conditions of $2L0' < L2 \approx L3 < L1 \approx L4 < L0 < 2L1$, or conditions of $2L0' < L2 = L3 < L1 = L4 < L0 < 2L1$. These requirements are referred to as a second requirement hereinafter.

Further, at the same time, the intervals L0 and L0' are preferably selected so that the interval L0 is larger than 6/16 of the wavelength of the pass-band frequency signal and is smaller than 8/16 thereof, the interval L0' is smaller than 2/16 of the wavelength of the pass-band frequency signal, and the interval (L0+L0') is determined at a value equal to about a quarter of the wavelength of the pass-band frequency signal. These requirements are referred to as a third requirement hereinafter.

The characteristic impedances of the parallel-coupled stubs 54 and 57 are set so as to be higher than the characteristic impedances Zo (normally Zo=50 Ω) of the input and output lines 58 and 59.

In the microwave band-pass filter shown in FIG. 5, since the parallel-coupled stubs 54 and 57 having the higher impedances are parallel-coupled through the electromagnetic couplings with the main line 53, the radiation losses from the ends of the parallel-coupled stubs 54 and 57 are decreased as compared with the first preferred embodiment, and then, this results in not only decreasing the insertion loss thereof on the pass-band but also increasing the insertion loss thereof on the stop-band.

Further, since the intervals L0 and L0', and the lengths L1, L2, L3 and L4 are set so as to satisfy the above-mentioned first and second requirements, the insertion loss steeply increases on a boundary band from one stop-band to the pass-band. In particular, there can be obtained the microwave band-pass filter having a simpler structure, in which the insertion loss steeply increases on the band higher than the pass-band, and the insertion loss on the band lower than the pass-band is relatively large over a relatively wide band.

Furthermore, since the characteristic impedances of the parallel-coupled stubs 54 and 57 are set so as to be higher than the characteristic impedances Zo of the input and output lines 58 and 59, the quality factors (Qs) on the stop-band of the parallel-coupled stubs 54 and 57 are increased, resulting in the microwave band-pass filter having more steep frequency characteristic on the outside of the pass-band.

Furthermore, since the open-ended stubs 54 and 57 having the longest lengths among the four open-ended stubs 54 to 57 are parallel-coupled through the electromagnetic couplings with the main line 53, the microwave band-pass filter can be miniaturized in size as compared with the first preferred embodiment.

Figure 7:
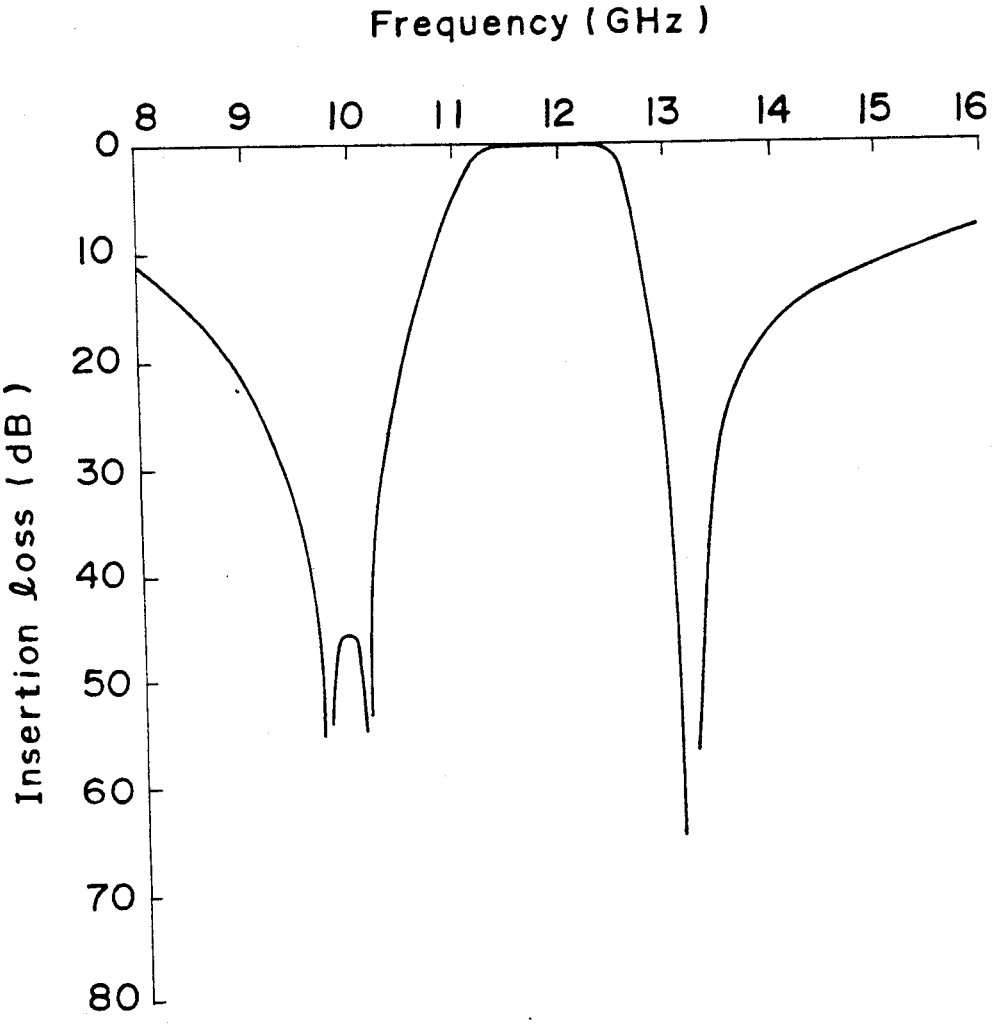
FIG. 7 is a graph showing a frequency characteristic of an insertion loss of the microwave band-pass filter shown in FIG. 5.

FIG. 7 is a graph showing a frequency characteristic of an insertion loss of the microwave band-pass filter shown in FIG. 5. In this case, parameters are set as follows:

(a) the relative dielectric constant of the dielectric substrates for the strip line is set to 2.5;

(b) the thickness thereof is set to 0.6 mm;

(c) the maximum line width of the main line 53 is set to 1.6 mm, resulting in setting the characteristic impedance Zo thereof to 50 Ω;

(d) the line width of each of the open-ended stubs 54 to 57 is set to 0.6 mm, resulting in setting the characteristic impedance thereof to 90 Ω;

(e) a space between the main line 53 and each of the open-ended stubs 54 and 57 is set to 0.18 mm; and (f) the intervals L0 and L0', and the lengths L1, L2, L3 and L4 are set so that L0=8.56 mm, L0'=0.71 mm, L1=5.74 mm, L2=L3=4.08 mm and L4=5.54 mm.

The microwave band-pass filter of the present preferred embodiment has a reflection loss larger than 15 dB in a frequency range from 11.5 to 12.4 GHz. As is apparent from FIG. 7, it has an insertion loss larger than 30 dB in a frequency range from 9.4 to 10.2 GHz, and has an insertion loss larger than 20 dB in a frequency range from 12.8 to 13.2 GHz.

Therefore, the microwave filter having the frequency characteristic shown in FIG. 7 has a pass-band from 11.5 to 12.4 GHz, and has a stop-band from 9.4 to 10.2

GHz and another stop-band from 12.7 to 13.2 GHz. In particular, the microwave filter of the present preferred embodiment certainly operates as a microwave band-pass filter requiring for a relatively large insertion loss on the band lower than the pass-band, and can be advantageously used as a microwave band-pass filter wherein the stop-bands thereof are located on both the outsides of the pass-band, band widths of the pass-band and the stop-band are finite, the insertion loss on the band lower than the pass-band is relatively large over a relatively wide band, and the insertion loss steeply increases on the band higher than the pass-band.

Furthermore, the intervals L0 and L0′ are preferably selected so as to satisfy the third requirement and so that the interval (L0 and L0′) is larger than 6/16 of the wavelength of the pass-band frequency signal and is smaller than 9/16 thereof. In this case, there can be obtained a superior microwave band-pass filter in which the insertion loss steeply increases on the band higher than the pass-band, and the insertion loss on the band lower than the pass-band is relatively large over a relatively wide band.

In the second preferred embodiment, the interval L0 between the stubs 54 and 55 is the same as that between the stubs 56 and 57. However, the present invention is not limited to this, the interval L0 between the stubs 54 and 55 may be substantially the same as that between the stubs 56 and 57, and then, there can be obtained substantially the same frequency characteristic thereof.

Third Preferred Embodiment

Figure 6:
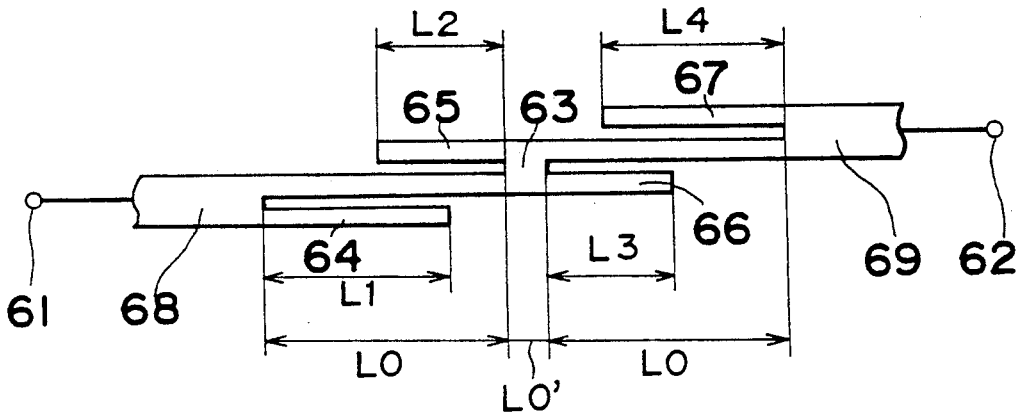
FIG. 6 is a pattern diagram showing a microwave band-pass filter of a third preferred embodiment according to the present invention.

FIG. 6 is a pattern diagram showing a microwave band-pass filter of a third preferred embodiment according to the present invention, in which the dielectric substrates are omitted.

Referring to FIG. 6, an input terminal 61 and an output terminal 62 are connected through input and output lines 68 and 69 each of a strip line, by a main line 63 composed of a strip line formed between dielectric substrates (not shown). Open-ended stubs or lines 64 and 67 having lengths L1 and L4 are parallel-coupled through electromagnetic couplings to the main line 63, respectively, so as to extend from ends of the input and output lines 68 and 69 toward the center of the main line 63 in a direction parallel to the longitudinal direction of the main line 63 on the lower and upper sides of the main line 63 in FIG. 5. Further, open-ended stubs or lines 65 and 66 having lengths L2 and L3 are parallel-coupled through electromagnetic couplings to the main line 63, respectively, at an interval L0′ from each other, so that the stub 65 extends from a position apart from the end of the input line 68 by an interval L0 in parallel to the longitudinal direction of the main line 63 toward the end of the input line 68 on the upper side of the main line 63 in FIG. 6, and the stub 66 extends from another position apart from the end of the output line 69 by the interval L0 in parallel to the longitudinal direction of the main line 63 toward the end of the output line 69 on the lower side of the main line 63 in FIG. 6. Namely, the stubs 64 to 67 are connected electrically in parallel to the main line 53 at the intervals L0, L0′ and L0 between the end of the input line 68 and the end of the output line 69.

The lengths L1 and L4 of the parallel-coupled stubs 64 and 67 are selected to be equal to a quarter or substantially a quarter of the wavelength of the stop-band frequency signal or the image signal on the band lower than the pass-band in such a manner that attenuation poles thereof are placed within or in the vicinity of the band of the stop-band frequency signal. Further, the lengths L2 and L3 of the open-ended stubs 65 and 66 are selected to be equal to a quarter or substantially a quarter of the wavelength of another stop-band frequency signal on the band higher than the pass-band in such a manner that attenuation poles thereof are placed within or in the vicinity of the band of another stop-band frequency signal. These requirements are referred to as a first requirement hereinafter.

The intervals L0 and L0′, and the lengths L1, L2, L3 and L4 are selected so as to satisfy either conditions of $2L0' < L2 \approx L3 < L1 \approx L4 < L0 < 2L1$, or conditions of $2L0' < L2 = L3 < L1 = L4 < L0 < 2L1$. These requirements are referred to as a second requirement hereinafter.

Further, at the same time, the intervals L0 and L0′ are preferably selected so that the interval L0 is larger than 6/16 of the wavelength of the pass-band frequency signal and is smaller than 8/16 thereof, the interval L0′ is smaller than 2/16 of the wavelength of the pass-band frequency signal, and the interval (L0+L0′) is determined at a value equal to about a quarter of the wavelength of the pass-band frequency signal. These requirements are referred to as a third requirement hereinafter.

The characteristic impedances of the parallel-coupled stubs 64 to 67 are set so as to be higher than the characteristic impedances Zo (normally Zo=50 Ω) of the input and output lines 68 and 69.

In the microwave band-pass filter shown in FIG. 6, since the parallel-coupled stubs 64 to 67 having the higher impedances are parallel-coupled through the electromagnetic couplings with the main line 63, the radiation losses from the ends of the parallel-coupled stubs 64 to 67 are decreased as compared with the first and second preferred embodiments, and then, this results in not only decreasing the insertion loss thereof on the pass-band but also increasing the insertion loss thereof on the stop-band.

Further, since the intervals L0 and L0′, and the lengths L1, L2, L3 and L4 are set so as to satisfy the above-mentioned first and second requirements, the insertion loss steeply increases on a boundary band from one stop-band to the pass-band. In particular, there can be obtained the microwave band-pass filter having a simpler structure, in which the insertion loss steeply increases on the band higher than the pass-band, and the insertion loss on the band lower than the pass-band is relatively large over a relatively wide band.

Furthermore, since the characteristic impedances of the parallel-coupled stubs 64 to 67 are set so as to be higher than the characteristic impedances Zo of the input and output lines 68 and 69, the quality factors (Qs) on the stop-band of the parallel-coupled stubs 64 to 67 are increased, resulting in the microwave band-pass filter having more steep frequency characteristics on both the outsides of the pass-band.

Furthermore, since the four open-ended stubs 64 to 67 are parallel-coupled through the electromagnetic couplings with the main line 63, the microwave band-pass filter can be miniaturized in size as compared with the first and second preferred embodiments.

Furthermore, in the third preferred embodiment, the intervals L0 and L0′ are preferably selected so that the interval (L0+L0′) is larger than 6/16 of the wavelength of the pass-band frequency signal and is smaller than 9/16 thereof.

In the third preferred embodiment, the interval L0 between the stubs 64 and 65 is the same as that between the stubs 66 and 67. However, the present invention is not limited to this, the interval L0 between the stubs 64 and 65 may be substantially the same as that between the stubs 66 and 67, and then, there can be obtained substantially the same frequency characteristic thereof.

Fourth Preferred Embodiment

Figure 8:
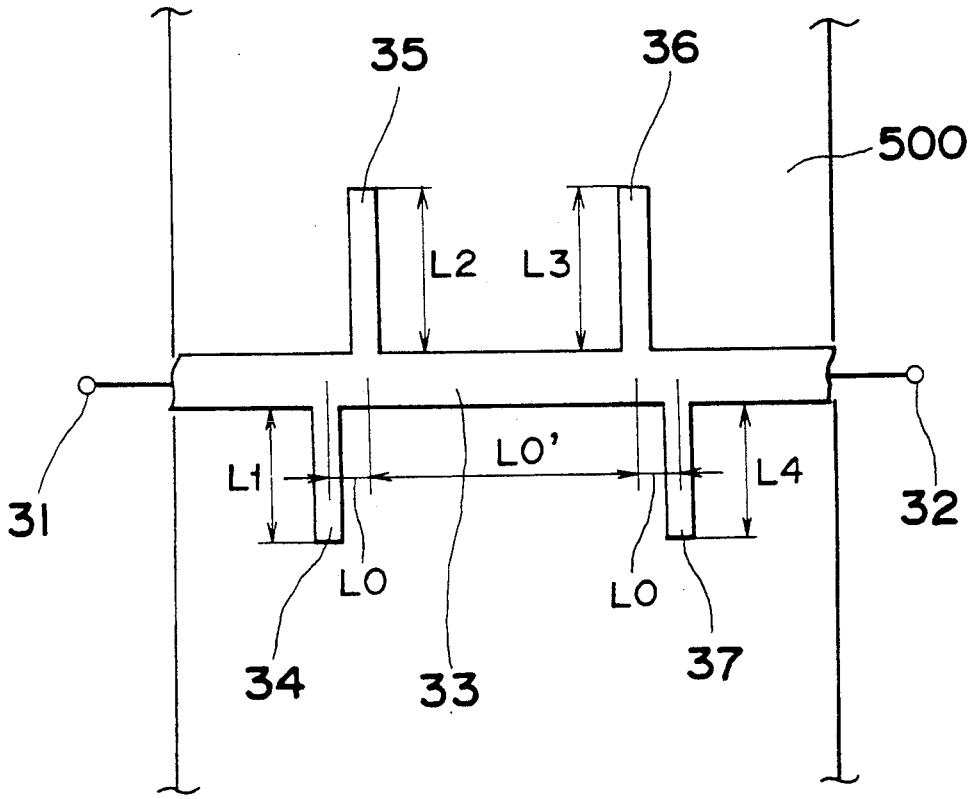
FIG. 8 is a plan view showing a microwave band-pass filter of a fourth preferred embodiment according to the present invention.

FIG. 8 shows a microwave band-pass filter of a fourth preferred embodiment according to the present invention.

Referring to FIG. 8, an input terminal 31 and an output terminal 32 are connected by a main line 33 composed of a strip line formed between a dielectric substrate 500 and another dielectric substrate (not shown). Open-ended stubs 34, 35, 36 and 37 having lengths L1, L2, L3 and L4 are connected in shunt with the main line 33, respectively, in an order of the stubs 34, 35, 36 and 37 at intervals L0, L0′ and L0 so that the stubs 35 and 36 extend toward the upper side in FIG. 8 and the stub 34 and 37 extend toward the lower side in FIG. 8.

The lengths L1 and L4 of the open-ended stubs 34 and 37 are selected to be equal to a quarter or substantially a quarter of the wavelength of the stop-band frequency signal or the image signal on the band higher than the pass-band in such a manner that attenuation poles thereof are placed within or in the vicinity of the band of the stop-band frequency signal. Further, the lengths L2 and L3 of the open-ended stubs 35 and 36 are selected to be equal to a quarter or substantially a quarter of the wavelength of another stop-band frequency signal on the band lower than the pass-band in such a manner that attenuation poles thereof are placed within or in the vicinity of the band of another stop-band frequency signal. These requirements are referred to as a first requirement hereinafter.

The intervals L0 and L0′, and the lengths L1, L2, L3 and L4 are selected so as to satisfy either conditions of $2L0<L1\approx L4<L2\approx L3<L0'<2L2$, or conditions of $2L0<L1=L4<L2=L3<L0'<2L2$. These requirements are referred to as a second requirement hereinafter.

Further, at the same time, the intervals L0 and L0′ are preferably selected so that the interval L0 is smaller than 2/16 of the wavelength of the pass-band frequency signal, the interval L0′ is larger than 6/16 of the wavelength of the pass-band frequency signal and is smaller than 8/16 thereof, and the interval (L0+L0′) is larger than 7/16 of the wavelength of the pass-band frequency and is smaller than 10/16 thereof. These requirement is referred to as a third requirement hereinafter.

Figure 9:
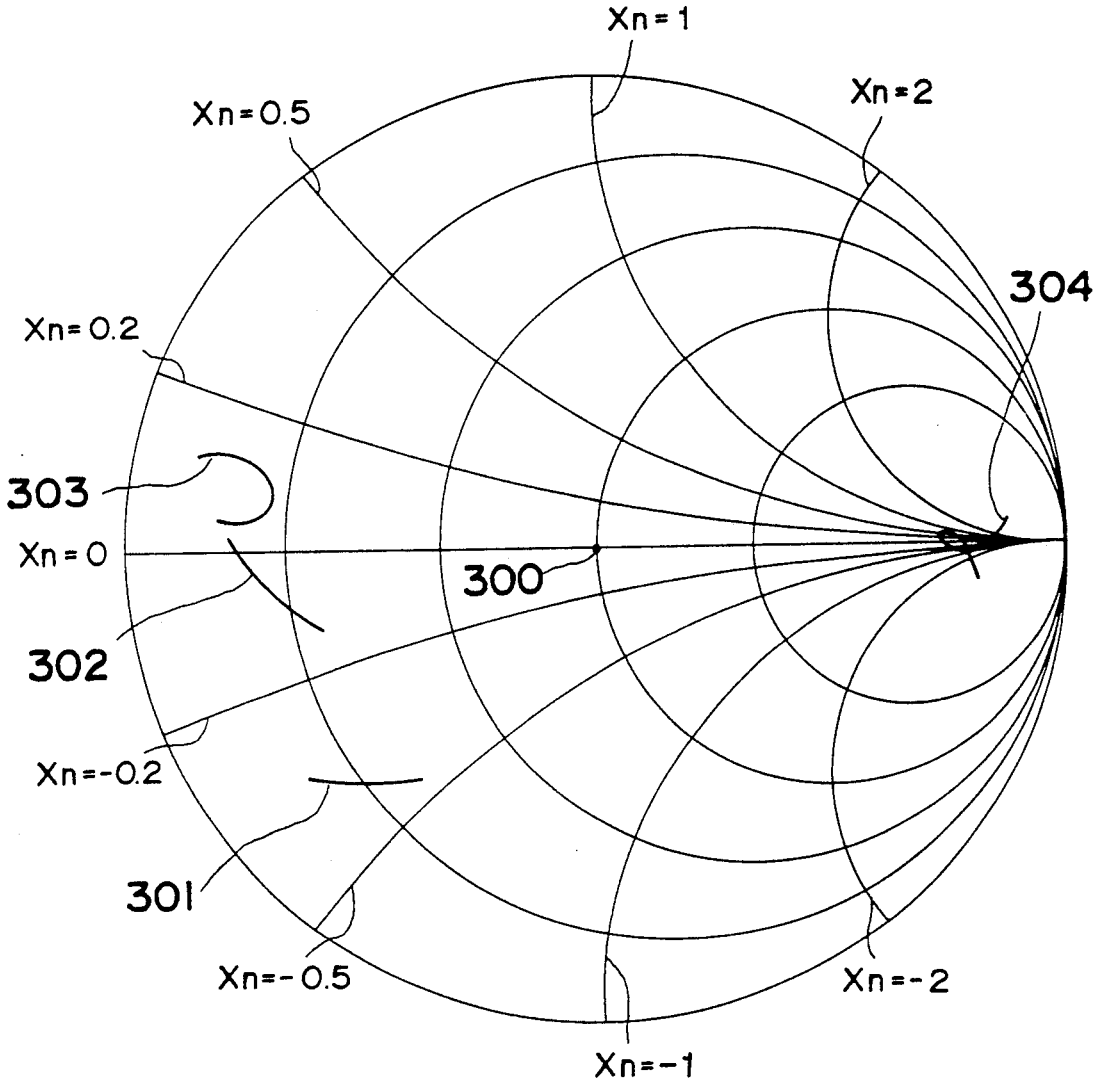
FIG. 9 is a Smith chart showing an action on a pass-band of the microwave band-pass filter shown in FIG. 8.

FIG. 9 is a Smith chart showing an action on a pass-band of the microwave band-pass filter shown in FIG. 8. The action on the pass-band having a predetermined frequency range thereof will be described below with reference to FIG. 9.

In the microwave band-pass filter shown in FIG. 8, each of the open-ended stubs 34 and 37 operates as a capacitive element connected electrically in parallel with the main line 33, and each of the open-ended stubs 35 and 36 operates as an inductive element connected electrically in parallel with the main line 33.

As shown in FIG. 9, an impedance 300 of a load having a characteristic impedance Zo connected to the input terminal 31 is converted into an impedance 301 changing in a relatively large range on the pass-band by the capacitive open-ended stub 34, and then, the impedance 301 is converted into an impedance 302 changing in a relatively large range on the pass-band by a strip line having the length L0 which is a part of the main line 33. Further, the impedance 302 is converted into a relatively low and inductive impedance 303 ($Z_{303}=R_{303}+jX_{303}$; $X_{303}>0$) changing in a relatively small range on the pass-band by the inductive open-ended stub 35, and then, the impedance 303 is converted into a relatively high and substantially purely resistive impedance 304 ($=R_{304}=Zo^2/R_{303}$) changing in a relatively small range on the pass-band by a strip line having half the length L0′ which is another part of the main line 33.

On the other hand, since the microwave band-pass filter of the present preferred embodiment has a symmetric structure to the input and output terminals 31 and 32, an impedance of a load having a characteristic impedance Zo connected to the output terminal 32 is converted into a relatively low and substantially purely resistive impedance changing in a relatively small range on the pass-band which is substantially the same as the impedance 304$=R_{304}$, by the capacitive open-ended stub 37, a strip line having the length L0 which is a part of the main line 33, the inductive open-ended stub 36 and a strip line having half the length L0′ which is another part of the main line 33.

Accordingly, the microwave band-pass filter shown in FIG. 8 has a band-pass characteristic on the pass-band, and has a band-stop characteristic on both the outsides of the pass-band by the open-ended stubs 34 to 37. Further, in the present preferred embodiment, the inductive open-ended stubs 35 and 36 operate, respectively, as means for converting the capacitive open-ended stubs 34 and 37 having the impedances changing in relatively large ranges on the pass-band into impedances changing in relatively small ranges on the pass-band. Therefore, since it is necessary to appropriately increase changes in the impedance or the inductances on the pass-band of the inductive open-ended stubs 35 and 36, the attenuation poles of the inductive open-ended stubs 35 and 36 are set so as to be closer to the pass-band frequency than the attenuation poles of the capacitive open-ended stubs 34 and 37.

Figure 10:
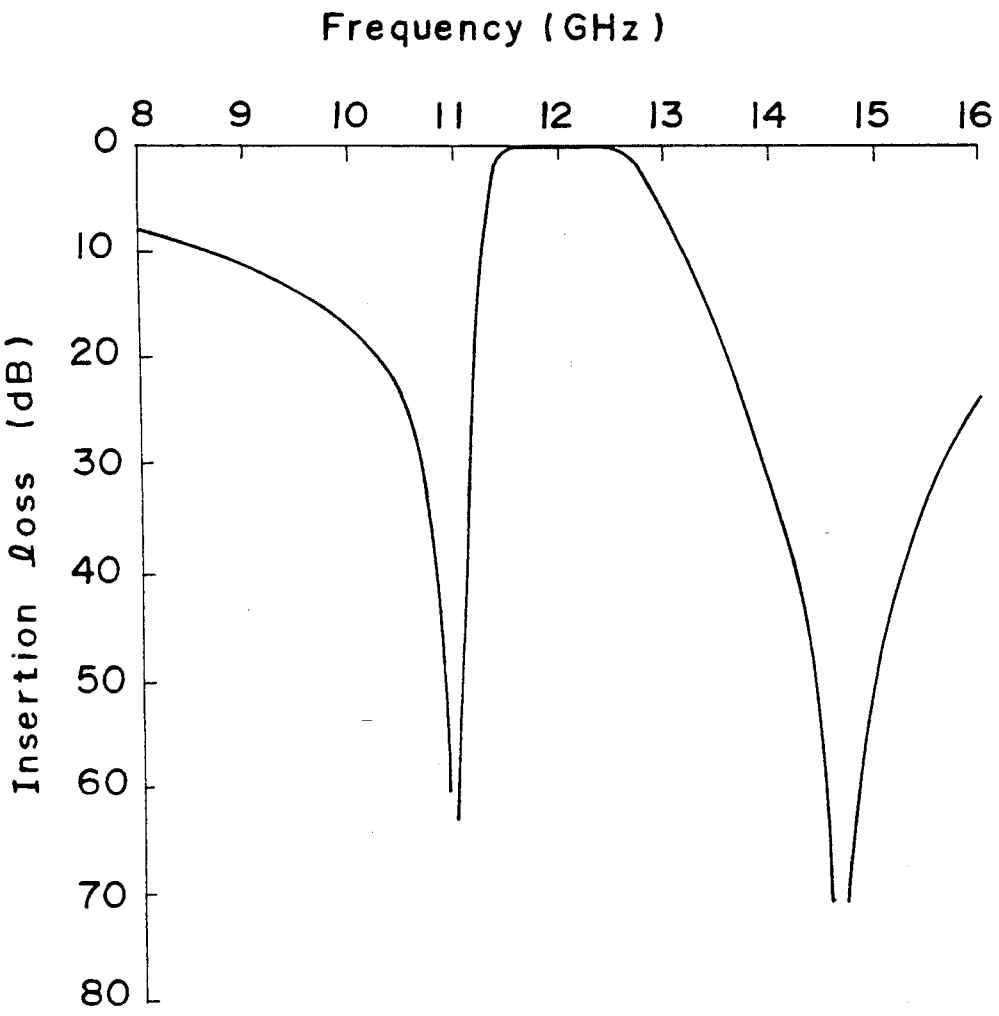
FIG. 10 is a graph showing a frequency characteristic of an insertion loss of the microwave band-pass filter shown in FIG. 8.

FIG. 10 is a graph showing a frequency characteristic of an insertion loss of the microwave band-pass filter shown in FIG. 8. In this case, parameters are set as follows:

(a) the relative dielectric constant of the dielectric substrates 500 for the strip line is set to 2.5;

(b) the thickness thereof is set to 0.6 mm;

(c) the line width of the main line 33 is set to 1.6 mm, resulting in setting the characteristic impedance Zo thereof to 50 Ω;

(d) the line width of each of the open-ended stubs 34 to 37 is set to 0.6 mm, resulting in setting the characteristic impedance thereof to 90 Ω; and (e) the intervals L0 and L0′, and the lengths L1, L2, L3 and L4 are set so that L0=0.89 mm, L0′=8.15 mm, L1=L4=3.63 mm, and L2=L3=4.88 mm.

The microwave band-pass filter of the present preferred embodiment has a reflection loss larger than 13 dB in a frequency range from 11.5 to 12.5 GHz. As is apparent from FIG. 10, it has an insertion loss larger than 20 dB in a frequency range from 10.3 to 11.2 GHz, and has an insertion loss larger than 30 dB in a frequency range from 14.0 to 15.6 GHz.

Therefore, the microwave filter having the frequency characteristic shown in FIG. 10 has a pass-band from 11.5 to 12.5 GHz, and has a stop-band from 10.3 to 11.2 GHz and another stop-band from 14.0 to 15.6 GHz. In particular, the microwave filter of the present preferred embodiment certainly operates as a microwave band-pass filter requiring for a relatively large insertion loss on the band higher than the pass-band, and can be advantageously used as a microwave band-pass filter wherein the stop-bands thereof are located on both the outsides of the pass-band, band widths of the pass-band and the stop-band are finite, the insertion loss on the band higher than the pass-band is relatively large over a relatively wide band, and the insertion loss steeply increases on the band lower than the pass-band.

Since the microwave band-pass filter shown in FIG. 8 has a structure comprising the open-ended stubs 34 to 37 connected electrically in parallel with the main line 33, the insertion loss on the pass-band can be decreased as compared with the conventional microwave band-pass filter shown FIG. 1. Further, since the intervals L0 and L0', and the lengths L1, L2, L3 and L4 are set so as to satisfy the above-mentioned first and second requirements, the insertion loss steeply increases on a boundary band from one stop-band to the pass-band. In particular, since the attenuation poles of the open-ended stubs are set to be adjacent to the lower band of the pass-band, this results in the microwave band-pass filter having a simpler structure, in which the insertion loss steeply increases on the band lower than the pass-band, and the insertion loss on the band higher than the pass-band is relatively large over a relatively wide band.

In the fourth preferred embodiment, the interval L0 between the stubs 34 and 35 is the same as that between the stubs 36 and 37. However, the present invention is not limited to this, the interval L0 between the stubs 34 and 35 may be substantially the same as that between the stubs 36 and 37, and then, there can be obtained substantially the same frequency characteristic thereof.

The following things can be relatively easily understood from the conversions of the impedances shown in FIG. 9. Since the intervals L0 and L0' are selected so as to satisfy the third requirement, there can be obtained a superior microwave band-pass filter in which the insertion loss steeply increases on the band lower than the pass-band, and the insertion loss on the band higher than the pass-band is relatively large over a relatively wide band.

Fifth Preferred Embodiment

Figure 11:
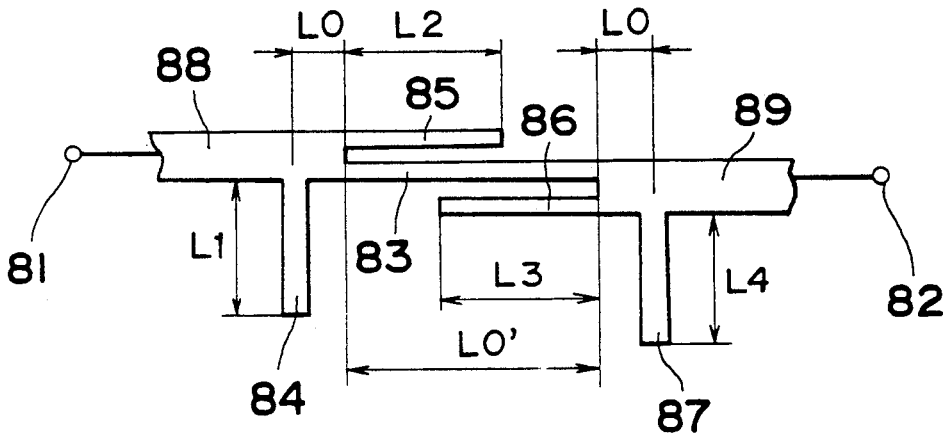
FIG. 11 is a pattern diagram showing a microwave band-pass filter of a fifth preferred embodiment according to the present invention.

FIG. 11 is a pattern diagram showing a microwave band-pass filter of a fifth preferred embodiment according to the present invention, in which the dielectric substrates are omitted.

Referring to FIG. 11, an input terminal 81 and an output terminal 82 are connected through input and output lines 88 and 89 each of a strip line, by a main line 83 composed of a strip line formed between dielectric substrates (not shown). Open-ended stubs 84 and 87 having lengths L1 and L4 are connected in shunt with the main line 83, respectively, at an interval (2L0+L0') from each other, so that the stub 84 extends from the end of the input line 88 toward the lower side in FIG. 11 and the stub 87 extends from the end of the output line 89 toward the lower side in FIG. 11. Further, open-ended stubs or lines 85 and 86 having lengths L2 and L3 are parallel-coupled through electromagnetic couplings to the main line 83, respectively, so that the stub 85 extends from a position apart from the end of the input line 88 by an interval L0 toward the output line 89 in a direction parallel to the longitudinal direction of the main line 83 on the upper side of the main line 83 in FIG. 11, and the stub 86 extends from another position apart from the end of the output line 89 by the interval L0 toward the input line 88 in a direction parallel to the longitudinal direction of the main line 83 on the lower side of the main line 83 in FIG. 11. Namely, the stubs 84 to 87 are connected electrically in parallel to the main line 83 at the intervals L0, L0' and L0 between the end of the input line 88 and the end of the output line 89.

The lengths L1 and L4 of the open-ended stubs 84 and 87 are selected to be equal to a quarter or substantially a quarter of the wavelength of the stop-band frequency signal or the image signal on the band higher than the pass-band in such a manner that attenuation poles thereof are placed within or in the vicinity of the band of the stop-band frequency signal. Further, the lengths L2 and L3 of the parallel-coupled stubs 85 and 86 are selected to be equal to a quarter or substantially a quarter of the wavelength of another stop-band frequency signal on the band lower than the pass-band in such a manner that attenuation poles thereof are placed within or in the vicinity of the band of another stop-band frequency signal. These requirements are referred to as a first requirement hereinafter.

The intervals L0 and L0', and the lengths L1, L2, L3 and L4 are selected so as to satisfy either conditions of $2L0<L1\approx L4<L2\approx L3<L0'<2L2$, or conditions of $2L0<L1=L4<L2=L3<L0'<2L2$. These requirements are referred to as a second requirement hereinafter.

Further, at the same time, the intervals L0 and L0' are preferably selected so that the interval L0 is smaller than 2/16 of the wavelength of the pass-band frequency signal, and the interval L0' is larger than 6/16 of the wavelength of the pass-band frequency signal and is smaller than 8/16 thereof, and the interval (L0+L0') is determined at a value larger than 7/16 of the wavelength of the pass-band frequency signal and smaller than 10/16 thereof. These requirements are referred to as a third requirement hereinafter.

The characteristic impedances of the parallel-coupled stubs 85 and 86 are set so as to be higher than the characteristic impedances Zo (normally Zo=50 Ω) of the input and output lines 88 and 89.

In the microwave band-pass filter shown in FIG. 11, since the parallel-coupled stubs 85 and 86 having the higher impedances are parallel-coupled through the electromagnetic couplings with the main line 83, the radiation losses from the ends of the parallel-coupled stubs 85 and 86 are decreased as compared with the fourth preferred embodiment, and then, this results in not only decreasing the insertion loss thereof on the pass-band but also increasing the insertion loss thereof on the stop-band.

Further, since the intervals L0 and L0', and the lengths L1, L2, L3 and L4 are set so as to satisfy the above-mentioned first and second requirements, the insertion loss steeply increases on a boundary band from one stop-band to the pass-band. In particular, there can be obtained the microwave band-pass filter having a simpler structure, in which the insertion loss steeply increases on the band lower than the pass-band, and the insertion loss on the band higher than the pass-band is relatively large over a relatively wide band.

Furthermore, since the characteristic impedances of the parallel-coupled stubs 85 and 86 are set so as to be higher than the characteristic impedances Zo of the input and output lines 88 and 89, the quality factors (Qs) on the stop-band of the parallel-coupled stubs 85 and 86 are increased, resulting in the microwave band-pass filter having more steep frequency characteristic on the outside of the pass-band.

Furthermore, since the open-ended stubs 85 and 86 having the longest lengths among the four open-ended stubs 84 to 87 are parallel-coupled through the electromagnetic couplings with the main line 83, the microwave band-pass filter can be miniaturized in size as compared with the fourth preferred embodiment.

In the fifth preferred embodiment, the interval L0 between the stubs 84 and 85 is the same as that between the stubs 86 and 87. However, the present invention is not limited to this, the interval L0 between the stubs 84 and 85 may be substantially the same as that between the stubs 86 and 87, and then, there can be obtained substantially the same frequency characteristic thereof.

Sixth Preferred Embodiment

Figure 12:
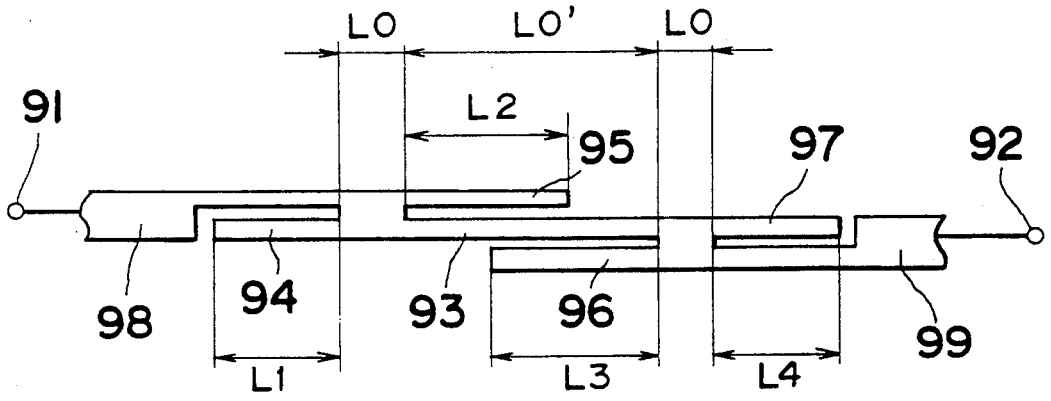
FIG. 12 is a pattern diagram showing a microwave band-pass filter of a sixth preferred embodiment according to the present invention.

FIG. 12 is a pattern diagram showing a microwave band-pass filter of a sixth preferred embodiment according to the present invention, in which the dielectric substrates are omitted.

Referring to FIG. 12, an input terminal 91 and an output terminal 92 are connected through input and output lines 98 and 99 each of a strip line, by a main line 93 composed of a strip line formed between dielectric substrates (not shown). Open-ended stubs or lines 94 and 97 having lengths L1 and L4 are parallel-coupled through electromagnetic couplings to the main line 93, respectively, so that the stub 94 extends toward the end of the input line 98 in a direction parallel to the longitudinal direction of the main line 93 on the lower side of the main line 93 in FIG. 12, and the stub 97 extends toward the end of the output line 99 in a direction parallel to the longitudinal direction of the main line 93 on the upper side of the main line 93 in FIG. 12. Further, open-ended stubs or lines 95 and 96 having lengths L2 and L3 are parallel-coupled through electromagnetic couplings to the main line 93, respectively, at an interval L0′ from each other, so that the stub 95 extends from a position apart from the connected end of the stub 94 by an interval L0 in parallel to the longitudinal direction of the main line 93 toward the output line 99 on the upper side of the main line 93 in FIG. 12, and the stub 96 extends from another position apart from the connected end of the stub 97 by the interval L0 in parallel to the longitudinal direction of the main line 93 toward the input line 98 on the lower side of the main line 93 in FIG. 12. Namely, the stubs 94 to 97 are connected electrically in parallel to the main line 93 at the intervals L0, L0′ and L0 between the end of the input line 98 and the end of the output line 99.

The lengths L1 and L4 of the parallel-coupled stubs 94 and 97 are selected to be equal to a quarter or substantially a quarter of the wavelength of the stop-band frequency signal or the image signal on the band higher than the pass-band in such a manner that attenuation poles thereof are placed within or in the vicinity of the band of the stop-band frequency signal. Further, the lengths L2 and L3 of the open-ended stubs 95 and 96 are selected to be equal to a quarter or substantially a quarter of the wavelength of another stop-band frequency signal on the band lower than the pass-band in such a manner that attenuation poles thereof are placed within or in the vicinity of the band of another stop-band frequency signal. These requirements are referred to as a first requirement hereinafter.

The intervals L0 and L0′, and the lengths L1, L2, L3 and L4 are selected so as to satisfy either conditions of $2L0<L1\approx L4<L2\approx L3<L0'<2L2$, or conditions of $2L0<L1=L4<L2=L3<L0'<2L2$. These requirements are referred to as a second requirement hereinafter.

Further, at the same time, the intervals L0 and L0′ are preferably selected so that the interval L0 is smaller than 2/16 of the wavelength of the pass-band frequency signal, the interval L0′ is larger than 6/16 of the wavelength of the pass-band frequency signal and is smaller than 8/16 thereof, and the interval (L0+L0′) is determined at a value larger than 7/16 of the wavelength of the pass-band frequency signal and smaller than 10/16 thereof. These requirements are referred to as a third requirement hereinafter.

The characteristic impedances of the parallel-coupled stubs 94 to 97 are set so as to be higher than the characteristic impedances Zo (normally Zo=50 Ω) of the input and output lines 98 and 99.

In the microwave band-pass filter shown in FIG. 12, since the parallel-coupled stubs 94 to 97 having the higher impedances are parallel-coupled through the electromagnetic couplings with the main line 93, the radiation losses from the ends of the parallel-coupled stubs 94 to 97 are decreased as compared with the fourth and fifth preferred embodiments, and then, this results in not only decreasing the insertion loss thereof on the pass-band but also increasing the insertion loss thereof on the stop-band.

Further, since the intervals L0 and L0′, and the lengths L1, L2, L3 and L4 are set so as to satisfy the above-mentioned first and second requirements, the insertion loss steeply increases on a boundary band from one stop-band to the pass-band. In particular, there can be obtained the microwave band-pass filter having a simpler structure, in which the insertion loss steeply increases on the band lower than the pass-band, and the insertion loss on the band higher than the pass-band is relatively large over a relatively wide band.

Furthermore, since the characteristic impedances of the parallel-coupled stubs 94 to 97 are set so as to be higher than the characteristic impedances Zo of the input and output lines 98 and 99, the quality factors (Qs) on the stop-band of the parallel-coupled stubs 94 to 97 are increased, resulting in the microwave band-pass filter having more steep frequency characteristics on both the outsides of the pass-band.

Furthermore, since the four open-ended stubs 94 to 97 are parallel-coupled through the electromagnetic couplings with the main line 93, the microwave band-pass filter can be miniaturized in size as compared with the fourth and fifth preferred embodiments.

In the sixth preferred embodiment, the interval L0 between the stubs 94 and 95 is the same as that between the stubs 96 and 97. However, the present invention is not limited to this, the interval L0 between the stubs 94 and 95 may be substantially the same as that between the stubs 96 and 97, and then, there can be obtained substantially the same frequency characteristic thereof.

Seventh Preferred Embodiment

Figure 13:
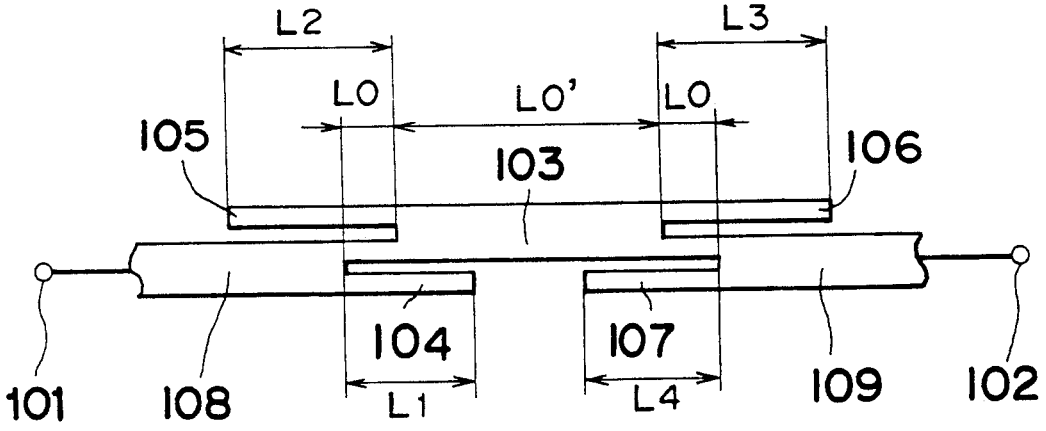
FIG. 13 is a pattern diagram showing a microwave band-pass filter of a seventh preferred embodiment according to the present invention.

FIG. 13 is a pattern diagram showing a microwave band-pass filter of a seventh preferred embodiment according to the present invention, in which the dielectric substrates are omitted.

Referring to FIG. 13, an input terminal 101 and an output terminal 102 are connected through input and output lines 108 and 109 each of a strip line, by a main line 103 composed of a strip line formed between dielectric substrates (not shown). Open-ended stubs 104 and 107 having lengths L1 and L4 are parallel-coupled through electromagnetic couplings to the main line 103, respectively, so that the stub 104 extends from the end of the input line 108 toward the open-end of the stub 107 and the output line 109 in a direction parallel to the longitudinal direction of the main line 103 on the lower side of the main line 103 in FIG. 13, and the stub 107 extends from the end of the output line 109 toward the open-end of the stub 104 and the input line 104 in a direction parallel to the longitudinal direction of the main line 103 on the lower side of the main line 103 in FIG. 13. Further, open-ended stubs 105 and 106 having lengths L2 and L3 are parallel-coupled through electromagnetic couplings to the main line 103, respectively, at an interval L0′ from each other, so that the stub 105 extends from a position apart from the end of the input line 108 by an interval L0 in parallel to the longitudinal direction of the main line 103 toward the input terminal 101 on the upper side of the main line 103 and the input line 108 in FIG. 13, and the stub 106 extends from another position apart from the end of the output line 109 by the interval L0 in parallel to the longitudinal direction of the main line 103 toward the output terminal 102 on the upper side of the main line 103 and the output line 109 in FIG. 13. Namely, the stubs 104 to 107 are connected electrically in parallel to the main line 103 at the intervals L0, L0′ and L0 between the end of the input line 108 and the end of the output line 109.

The lengths L1 and L4 of the open-ended stubs 104 and 107 are selected to be equal to a quarter or substantially a quarter of the wavelength of the stop-band frequency signal or the image signal on the band higher than the pass-band in such a manner that attenuation poles thereof are placed within or in the vicinity of the band of the stop-band frequency signal. Further, the lengths L2 and L3 of the parallel-coupled stubs 105 and 106 are selected to be equal to a quarter or substantially a quarter of the wavelength of another stop-band frequency signal on the band lower than the pass-band in such a manner that attenuation poles thereof are placed within or in the vicinity of the band of another stop-band frequency signal. These requirements are referred to as a first requirement hereinafter.

The intervals L0 and L0′, and the lengths L1, L2, L3 and L4 are selected so as to satisfy either conditions of $2L0<L1\approx L4<L2\approx L3<L0'<2L2$, or conditions of $2L0<L1=L4<L2=L3<L0'<2L2$. These requirements are referred to as a second requirement hereinafter.

Further, at the same time, the intervals L0 and L0′ are preferably selected so that the interval L0 is smaller than 2/16 of the wavelength of the pass-band frequency signal, the interval L0′ is larger than 6/16 of the wavelength of the pass-band frequency signal and is smaller than 8/16 thereof, and the interval (L0+L0′) is determined at a value larger than 7/16 of the wavelength of the pass-band frequency signal and smaller than 10/16 thereof. These requirements are referred to as a third requirement hereinafter.

The characteristic impedances of the parallel-coupled stubs 104 to 107 are set so as to be higher than the characteristic impedances Zo (normally Zo=50 Ω) of the input and output lines 108 and 109.

In the microwave band-pass filter shown in FIG. 13, since the parallel-coupled stubs 104 to 107 having the higher impedances are parallel-coupled through the electromagnetic couplings with the main line 103, the radiation losses from the ends of the parallel-coupled stubs 104 to 107 are decreased as compared with the fourth and fifth preferred embodiments, and then, this results in not only decreasing the insertion loss thereof on the pass-band but also increasing the insertion loss thereof on the stop-band.

Further, since the intervals L0 and L0′, and the lengths L1, L2, L3 and L4 are set so as to satisfy the above-mentioned first and second requirements, the insertion loss steeply increases on a boundary band from one stop-band to the pass-band. In particular, there can be obtained the microwave band-pass filter having a simpler structure, in which the insertion loss steeply increases on the band lower than the pass-band, and the insertion loss on the band higher than the pass-band is relatively large over a relatively wide band.

Furthermore, since the characteristic impedances of the parallel-coupled stubs 104 to 107 are set so as to be higher than the characteristic impedances Zo of the input and output lines 108 and 109, the quality factors (Qs) on the stop-band of the parallel-coupled stubs 104 to 107 are increased, resulting in the microwave band-pass filter having more steep frequency characteristics on both the outsides of the pass-band.

Furthermore, since the four open-ended stubs 104 to 107 are parallel-coupled through the electromagnetic couplings with the main line 103, the microwave band-pass filter can be miniaturized in size as compared with the fourth and fifth preferred embodiments.

Figure 14:
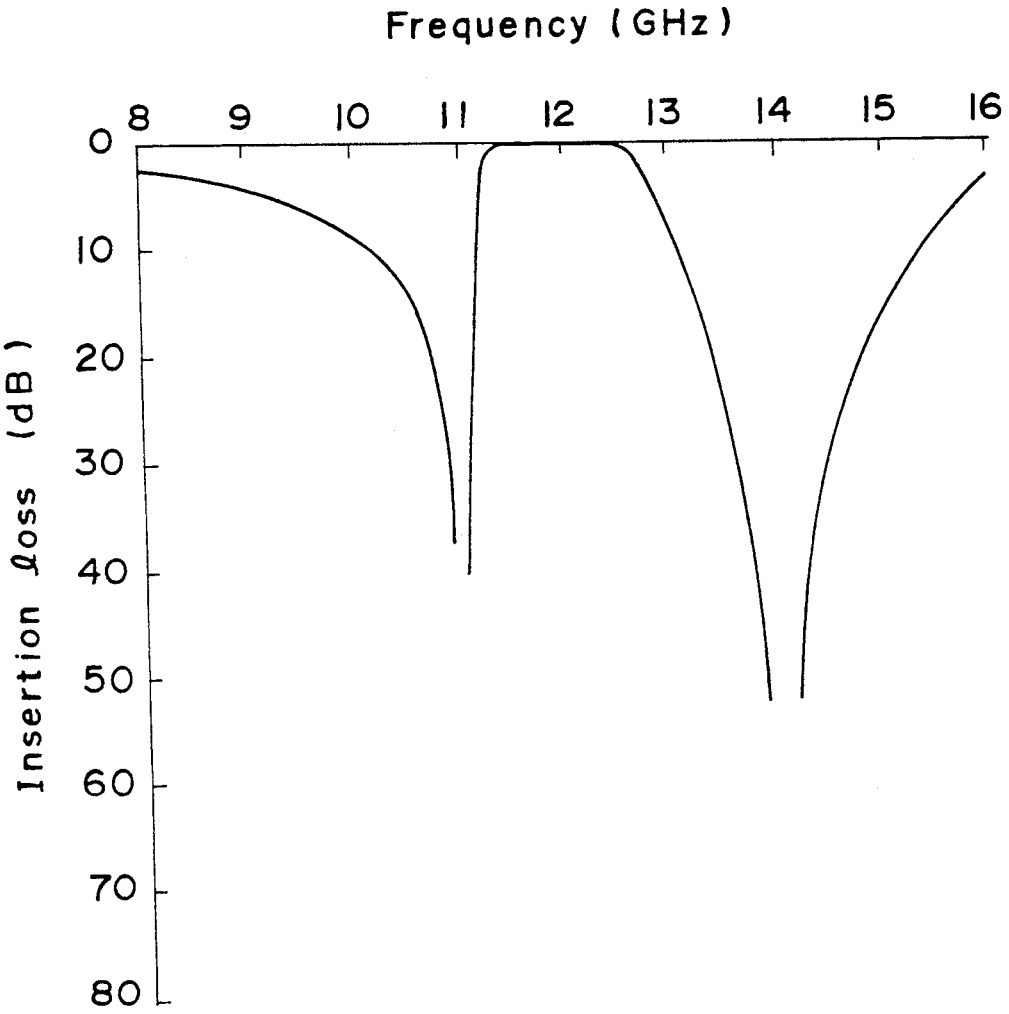
FIG. 14 is a graph showing a frequency characteristic of an insertion loss of the microwave band-pass filter shown in FIG. 13.

FIG. 14 is a graph showing a frequency characteristic of an insertion loss of the microwave band-pass filter shown in FIG. 13. In this case, parameters are set as follows:

(a) the relative dielectric constant of the dielectric substrates for the strip line is set to 2.5;

(b) the thickness thereof is set to 0.6 mm;

(c) the maximum line width of the main line 103 is set to 1.6 mm, resulting in setting the characteristic impedance Zo thereof to 50 Ω;

(d) the line width of each of the open-ended stubs 104 to 107 is set to 0.6 mm, resulting in setting the characteristic impedance thereof to 90 Ω;

(e) a space between the main line 103 and each of the open-ended stubs 104 to 107 is set to 0.18 mm; and (f) the intervals L0 and L0′, and the lengths L1, L2, L3 and L4 are set so that L0=1.6 mm, L0′=7.7 mm, L1=3.98 mm, L2=L3=5.0 mm and L4=4.03 mm.

The microwave band-pass filter of the present preferred embodiment has a reflection loss larger than 15 dB in a frequency range from 11.3 to 12.4 GHz. As is apparent from FIG. 14, it has an insertion loss larger than 20 dB in a frequency range from 10.8 to 11.1 GHz, and has an insertion loss larger than 30 dB in a frequency range from 13.6 to 14.4 GHz.

Therefore, the microwave filter having the frequency characteristic shown in FIG. 14 has a pass-band from 11.3 to 12.4 GHz, and has a stop-band from 10.8 to 11.1 GHz and another stop-band from 13.6 to 14.4 GHz. In particular, the microwave filter of the present preferred embodiment certainly operates as a microwave band-pass filter requiring for a relatively large insertion loss on the band high than the pass-band, and can be advantageously used as a microwave band-pass filter wherein the stop-bands thereof are located on both the outsides of the pass-band, band widths of the pass-band and the stop-band are finite, the insertion loss on the band higher than the pass-band is relatively large over a relatively wide band, and the insertion loss steeply increases on the band lower than the pass-band.

Furthermore, since the intervals L0 and L0′ are selected so as to satisfy the third requirement, there can be obtained the microwave band-pass filter in which the insertion loss steeply increases on the band lower than the pass-band, and the insertion loss on the band higher than the pass-band is relatively large over a relatively wide band.

In the seventh preferred embodiment, the interval L0 between the stubs 104 and 105 is the same as that between the stubs 106 and 107. However, the present invention is not limited to this, the interval L0 between the stubs 104 and 105 may be substantially the same as that between the stubs 106 and 107, and then, there can be obtained substantially the same frequency characteristic thereof.

Advantageous Effects

As is apparent from the above description, the microwave band-pass filters of the preferred embodiments have the following advantageous effects.

(a) Since the microwave band-pass filter of each preferred embodiment has a structure comprising the open-ended stubs connected electrically in parallel with the main line, the insertion loss on the pass-band can be decreased as compared with the conventional microwave band-pass filter shown FIG. 1.

(b) Since the intervals L0 and L0′, and the lengths L1, L2, L3 and L4 are set so as to satisfy the above-mentioned first and second requirements of each preferred embodiment, the insertion loss steeply increases on a boundary band from one stop-band to the pass-band. In particular, since the attenuation poles of the open-ended stubs are set to be adjacent to the higher band or the lower band of the pass-band, this results in the microwave band-pass filter having a simpler structure, in which the insertion loss steeply increases on the band higher or lower than the pass-band, and the insertion loss on the band lower or higher than the pass-band is relatively large over a relatively wide band, respectively.

(c) In the third, sixth and seventh preferred embodiments, since the open-ended stubs are parallel-coupled with the main line having a length of one or half the one wavelength of the pass-band frequency signal, each microwave band-pass filter can be further miniaturized in size.

(d) In the second, third, fifth, sixth and seventh preferred embodiments, since the parallel-coupled stubs having the higher impedances are parallel-coupled through the electromagnetic couplings with the main line, the radiation losses from the ends of the parallel-coupled stubs are decreased as compared with the conventional microwave band-pass filter shown in FIG. 1, and then, this results in not only decreasing the insertion loss thereof on the pass-band but also increasing the insertion loss thereof on the stop-band.

Other Modifications

In the above-mentioned preferred embodiments, the strip lines are used, however, the present invention is not limited to this. The other kinds of microwave transmission lines such as micro-strip lines or the like may be used.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A microwave band-pass filter comprising:

a main line having an input terminal and an output terminal on both ends thereof; and first, second, third and fourth open-ended stubs having lengths L1, L2, L3 and L4, respectively, said first to fourth open-ended stubs connected electrically in parallel to said main line at intervals L0, L0′ and L0″, respectively, wherein (a) the lengths L1 and L4 of said first and fourth open-ended stubs are selected to be substantially equal to a quarter of the wavelength of the first stop-band frequency signal on the band lower than the pass-band in such a manner that attenuation poles thereof are placed substantially within the band of the first stop-band frequency signal;

(b) the lengths L2 and L3 of said second and third open-ended stubs are selected to be substantially equal to a quarter of the wavelength of the second stop-band frequency signal on the band higher than the pass-band in such a manner that attenuation poles thereof are placed substantially within the band of the second stop-band frequency signal;

(c) the intervals L0, L0′ and L0″, and the lengths L1, L2, L3 and L4 are selected so as to satisfy either one of first conditions of $2L0' < L2 \approx L3 < L1 \approx L4 < L0 < 2L1$, and second conditions of $2L0' < L2 = L3 < L1 = L4 < L0 < 2L1$ and so that $L0'' = L0$ or $L0'' \approx L0$.

2. The microwave band-pass filter as claimed in claim 1, wherein the intervals L0 and L0′ are selected so that the interval L0 is larger than 6/16 of the wavelength of the pass-band frequency signal and is smaller than 8/16 thereof, the interval L0′ is smaller than 2/16 of the wavelength of the pass-band frequency signal, and the interval (L0+L0′) is larger than 6/16 of the wavelength of the pass-band frequency signal and is smaller than 9/16 thereof.

3. The microwave band-pass filter as claimed in claim 1, further comprising:

an input line connected between said input terminal and said main line; and an output line connected between said output terminal and said main line;

wherein said first and fourth open-ended stubs are parallel-coupled with said main line so as to extend in parallel to a longitudinal direction of said main line, and characteristic impedances of said first and fourth open-ended stubs are larger than those of said input and output lines, respectively.

4. The microwave band-pass filter as claimed in claim 3, wherein the intervals L0 and L0′ are selected so that the interval L0 is larger than 6/16 of the wavelength of the pass-band frequency signal and is smaller than 8/16 thereof, the interval L0′ is smaller than 2/16 of the wavelength of the pass-band frequency signal, and the interval (L0+L0') is larger than 6/16 of the wavelength of the pass-band frequency signal and is smaller than 9/16 thereof.

5. The microwave band-pass filter as claimed in claim 3, wherein said first and fourth open-ended stubs extend toward the center of said main line.

6. The microwave band-pass filter as claimed in claim 4, wherein said first and fourth open-ended stubs extend toward the center of said main line.

7. The microwave band-pass filter as claimed in claim 3, wherein said second and third open-ended stubs are parallel-coupled with said main line so as to extend in parallel to the longitudinal direction of said main line, and characteristic impedances of said second and third open-ended stubs are larger than those of said input and output lines, respectively.

8. The microwave band-pass filter as claimed in claim 7, wherein the intervals L0 and L0' are selected so that the interval L0 is larger than 6/16 of the wavelength of the pass-band frequency signal and is smaller than 8/16 thereof, the interval L0' is smaller than 2/16 of the wavelength of the pass-band frequency signal, and the interval (L0+L0') is larger than 6/16 of the wavelength of the pass-band frequency signal and is smaller than 9/16 thereof.

9. The microwave band-pass filter as claimed in claim 7, wherein said second open-ended stub extends toward said input line, and said third open-ended stub extends toward said output line.

10. The microwave band-pass filter as claimed in claim 8, wherein said second open-ended stub extends toward said input line, and said third open-ended stub extends toward said output line.

11. A microwave band-pass filter comprising:

a main line having an input terminal and an output terminal on both ends thereof; and first, second, third and fourth open-ended stubs having lengths L1, L2, L3 and L4, respectively, said first to fourth open-ended stubs connected electrically in parallel to said main line at intervals L0, L0' and L0'', respectively, wherein (a) the lengths L1 and L4 of said first and fourth open-ended stubs are selected to be substantially equal to a quarter of the wavelength of the first stop-band frequency signal on the band higher than the pass-band in such a manner that attenuation poles thereof are placed substantially within the band of the first stop-band frequency signal;

(b) the lengths L2 and L3 of said second and third open-ended stubs are selected to be substantially equal to a quarter of the wavelength of the second stop-band frequency signal on the band lower than the pass-band in such a manner that attenuation poles thereof are placed substantially within the band of the second stop-band frequency signal; and (c) the intervals L0, L0' and L0'', and the lengths L1, L2, L3 and L4 are selected so as to satisfy either one of first conditions of $2L0<L1\approx L4<L2\approx L3<L0'<2L2$, and second conditions of $2L0<L1=L4<L2=L3<L0'<2L2$ and so that $L0''=L0$ or $L0''\approx L0$.

12. The microwave band-pass filter as claimed in claim 11, wherein the intervals L0 and L0' are selected so that the interval L0 is smaller than 2/16 of the wavelength of the pass-band frequency signal, the interval L0' is larger than 6/16 of the wavelength of the pass-band frequency signal and is smaller than 8/16 thereof, and the interval (L0+L0') is larger than 7/16 of the wavelength of the pass-band frequency signal and is smaller than 10/16 thereof.

13. The microwave band-pass filter as claimed in claim 11, further comprising:

an input line connected between said input terminal and said main line; and an output line connected between said output terminal and said main line;

wherein said second and third open-ended stubs are parallel-coupled with said main line so as to extend in parallel to a longitudinal direction of said main line, and characteristic impedances of said second and third open-ended stubs are larger than those of said input and output lines, respectively.

14. The microwave band-pass filter as claimed in claim 13, wherein the intervals L0 and L0' are selected so that the interval L0 is smaller than 2/16 of the wavelength of the pass-band frequency signal, the interval L0' is larger than 6/16 of the wavelength of the pass-band frequency signal and is smaller than 8/16 thereof, and the interval (L0+L0') is larger than 7/16 of the wavelength of the pass-band frequency signal and is smaller than 10/16 thereof.

15. The microwave band-pass filter as claimed in claim 13, wherein said second open-ended stub extends toward said output line, and said third open-ended stub extends toward said input line.

16. The microwave band-pass filter as claimed in claim 14, wherein said second open-ended stub extends toward said output line, and said third open-ended stub extends toward said input line.

17. The microwave band-pass filter as claimed in claim 13, wherein said first and fourth open-ended stubs are parallel-coupled with said main line so as to extend in parallel to the longitudinal direction of said main line, and characteristic impedances of said first and fourth open-ended stubs are larger than those of said input and output lines, respectively.

18. The microwave band-pass filter as claimed in claim 17, wherein the intervals L0 and L0' are selected so that the interval L0 is smaller than 2/16 of the wavelength of the pass-band frequency signal, the interval L0' is larger than 6/16 of the wavelength of the pass-band frequency signal and is smaller than 8/16 thereof, and the interval (L0+L0') is larger than 7/16 of the wavelength of the pass-band frequency signal and is smaller than 10/16 thereof.

19. The microwave band-pass filter as claimed in claim 17, wherein said first open-ended stub extends toward said input line, and said fourth open-ended stub extends toward said output line.

20. The microwave band-pass filter as claimed in claim 18, wherein said first open-ended stub extends toward said input line, and said fourth open-ended stub extends toward said output line.

21. The microwave band-pass filter as claimed in claim 17, wherein said second open-ended stub extends toward said input terminal, said third open-ended stub extends toward said output terminal, and said first and fourth open-ended stubs extend toward open-ends of each other.

22. The microwave band-pass filter as claimed in claim 18, wherein said second open-ended stub extends toward said input terminal, said third open-ended stub extends toward said output terminal, and said first and fourth open-ended stubs extend toward open-ends of each other.

* * * * *